US006742882B2

(12) United States Patent
Nakamura

(10) Patent No.: US 6,742,882 B2
(45) Date of Patent: Jun. 1, 2004

(54) AIR PURGE DEVICE FOR INK JET RECORDING APPARATUS

(75) Inventor: Hirotake Nakamura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/178,613

(22) Filed: Jun. 25, 2002

(65) Prior Publication Data

US 2002/0196316 A1 Dec. 26, 2002

(30) Foreign Application Priority Data

Jun. 26, 2001 (JP) ..... 2001-193543

(51) Int. Cl.[7] ..... B41J 2/18
(52) U.S. Cl. ..... 347/89; 347/92
(58) Field of Search ..... 347/85, 89, 92

(56) References Cited

U.S. PATENT DOCUMENTS

| | | | | | |
|---|---|---|---|---|---|
| 4,323,907 | A | * | 4/1982 | Italiano | 347/85 |
| 4,380,770 | A | | 4/1983 | Maruyama | 347/29 |
| 4,462,037 | A | * | 7/1984 | Bangs et al. | 347/85 |
| 4,714,931 | A | * | 12/1987 | Erskine et al. | 347/7 |
| 5,113,205 | A | * | 5/1992 | Sato et al. | 347/85 |
| 5,159,348 | A | * | 10/1992 | Dietl et al. | 347/89 |
| 5,835,110 | A | | 11/1998 | Sasaki | 347/40 |
| 6,082,851 | A | * | 7/2000 | Shiloh et al. | 347/85 |
| 6,113,223 | A | * | 9/2000 | Tanaka et al. | 347/65 |
| 6,120,140 | A | * | 9/2000 | Hirosawa et al. | 347/93 |
| 6,231,174 | B1 | | 5/2001 | Haigo | 347/89 |
| 6,331,055 | B1 | * | 12/2001 | Miller et al. | 347/92 |
| 6,561,637 | B2 | * | 5/2003 | Hino | 347/92 |

FOREIGN PATENT DOCUMENTS

| | | |
|---|---|---|
| JP | A 56-75867 | 6/1981 |
| JP | A 2000-103084 | 4/2000 |

* cited by examiner

*Primary Examiner*—Juanita Stephens
*Assistant Examiner*—Blaise Mouttet
(74) *Attorney, Agent, or Firm*—Oliff & Berridge, PLC

(57) ABSTRACT

An inner surface of a ceiling wall is provided at an angle of approximately 5 degrees to 10 degrees, with respect to a horizontal surface. An outlet to a second ink channel is disposed at a higher position of the ceiling wall than a first ink channel. An inlet connected to the first ink channel is provided such that an end of the inlet terminates near a bottom of a buffer tank. When a circulation purge operation is performed by circulating ink from a sub-tank to the buffer tank, through the first ink channel, and from the buffer tank to the sub-tank, through the second ink channel, air bubbles in the buffer tank move along the angled or inclined inner surface of the ceiling wall, to the outlet provided at a higher position. The air bubbles are smoothly discharged through the outlet. The air bubbles collected to the sub-tank are released into the atmosphere through an air releasing portion.

21 Claims, 2 Drawing Sheets

AIR PURGE DEVICE FOR INK JET RECORDING APPARATUS

BACKGROUND OF THE INVENTION

1. Field of Invention

The invention relates to an ink jet recording apparatus, and, more particularly, to an ink jet recording apparatus that includes a device for circulating ink between a print head and an ink tank to remove air bubbles in the ink circulation channel.

2. Description of Related Art

In a known ink jet recording apparatus that ejects ink onto a recording medium based on input signals, ink is supplied from an ink tank to a plurality of ink ejection channels of a print head, through an ink channel. Actuators, such as heating elements and piezoelectric elements, of the print head are selectively driven to eject ink from the tips of the ink ejection channels (nozzles).

For example, U.S. Pat. No. 4,380,770 and Japanese Laid-Open Patent Publication No. 2000-103084 disclose ink jet print heads that execute a circulation purge operation by circulating ink through the ink circulation channel to remove air bubbles in the ink circulation channel. More specifically, the ink circulation channel is provided between a manifold or a reservoir connected to a print head and an ink tank. The ink circulation channel includes a first ink channel for guiding ink from the ink tank to the manifold, and a second ink channel for returning or collecting ink from the manifold to the ink tank. Each of the first and the second ink channels is connected to the manifold and the ink tank. An ink circulation pump is provided in the second ink channel. Using the ink circulation pump, ink is circulated through the ink circulation channel from the ink tank to the manifold through the first ink channel, and from the manifold to the ink tank through the second ink channel. Air bubbles in the ink circulation channel are forced into the ink tank by the ink circulation purge operation, along with the circulating ink. The air bubbles are released from the ink tank to the atmosphere.

U.S. Pat. No. 4,380,770 and Japanese Laid-Open Patent Publication No. 2000-103084 also disclose execution of a suction purge operation after the circulation purge operation. In the suction purge operation, the second ink channel is closed and a nozzle surface of the print head is covered with a suction cap. By driving a suction pump, air bubbles are removed from the ink ejection channels of the print head, together with the ink in the ink ejection channels.

Print heads have been downsized as technology in the field has advanced in recent years. Accordingly, the size (volume) of the manifold and the ink storage capacity of the manifold have been reduced. If the air bubbles enter a manifold of smaller size, for example, when ink is directly supplied to the manifold after an ink tank is replaced, the ratio of air bubbles to ink in the manifold becomes higher. Further, air enters the manifold through a flexible tube of, for example, the first ink channel, because the flexible tube inevitably has a characteristic that air permeates the flexible tube. Air entering through the flexible tube is dissolved in the ink in the tube and develops into air bubbles with the passage of time. The air bubbles eventually enter the manifold. The manifold is disposed above the ink ejection channels of the print head, so that the air bubbles in the manifold are likely to be pulled into the ink ejection channels of the print head. Entry of the air bubbles into the ink ejection channels causes ink ejection failures.

SUMMARY OF THE INVENTION

To prevent the above-described drawbacks, it is contemplated that a buffer tank with larger capacity is provided at a position higher than the manifold and between the manifold and the first and second ink channels. The first and second ink channels are provided between the buffer tank and the ink tank. An ink circulation pump is provided in the second ink channel. The ink circulation purge is performed using the ink circulation pump by circulating ink between the ink tank and the buffer tank through the first and second ink channels.

However, when a ceiling of the buffer tank is substantially horizontal and an outlet to the second ink channel is formed at a portion of the horizontal ceiling of the buffer tank, air bubbles do not readily or smoothly move toward the outlet even if the air bubbles to be removed from the ink in the buffer tank are moved upward to the ceiling. Accordingly, the air bubbles are incompletely removed.

Ink jet recording apparatuses are generally placed on a substantially horizontal surface, such as a table or a shelf board. However, if an ink jet recording apparatus is placed at an angle or slightly inclined, such that the ceiling of the buffer tank on the side of the outlet is lowered, the air bubbles collect in the uppermost portion of the buffer tank, so that the air bubbles in the buffer tank cannot be removed.

Accordingly, one aspect of the invention is to provide an ink jet recording apparatus that includes a device for removing air bubbles in an ink channel and separating air bubbles from the ink using simple structures.

According to one aspect of the invention, an ink jet recording apparatus may include a print head that has a plurality of ink ejection channels, an ink tank that stores ink, a buffer tank that has an inlet and an outlet and stores the ink supplied from the ink tank, a first ink channel that supplies the ink from the ink tank to the buffer tank through the inlet, a second ink channel that collects the ink from the buffer tank to the ink tank through the outlet, and a pump that is activated to remove air bubbles by circulating the ink between the ink tank, the first ink channel, the buffer tank, and the second ink channel, and wherein the outlet is disposed higher than the inlet at a ceiling of the buffer tank.

BRIEF DESCRIPTION OF THE DRAWINGS

Embodiments of the invention will be described with reference to the accompanying drawings in which like elements are labeled with like numbers and in which.

DETAILED DESCRIPTION OF PREFERRED EMBODIMENTS

Figure 1:
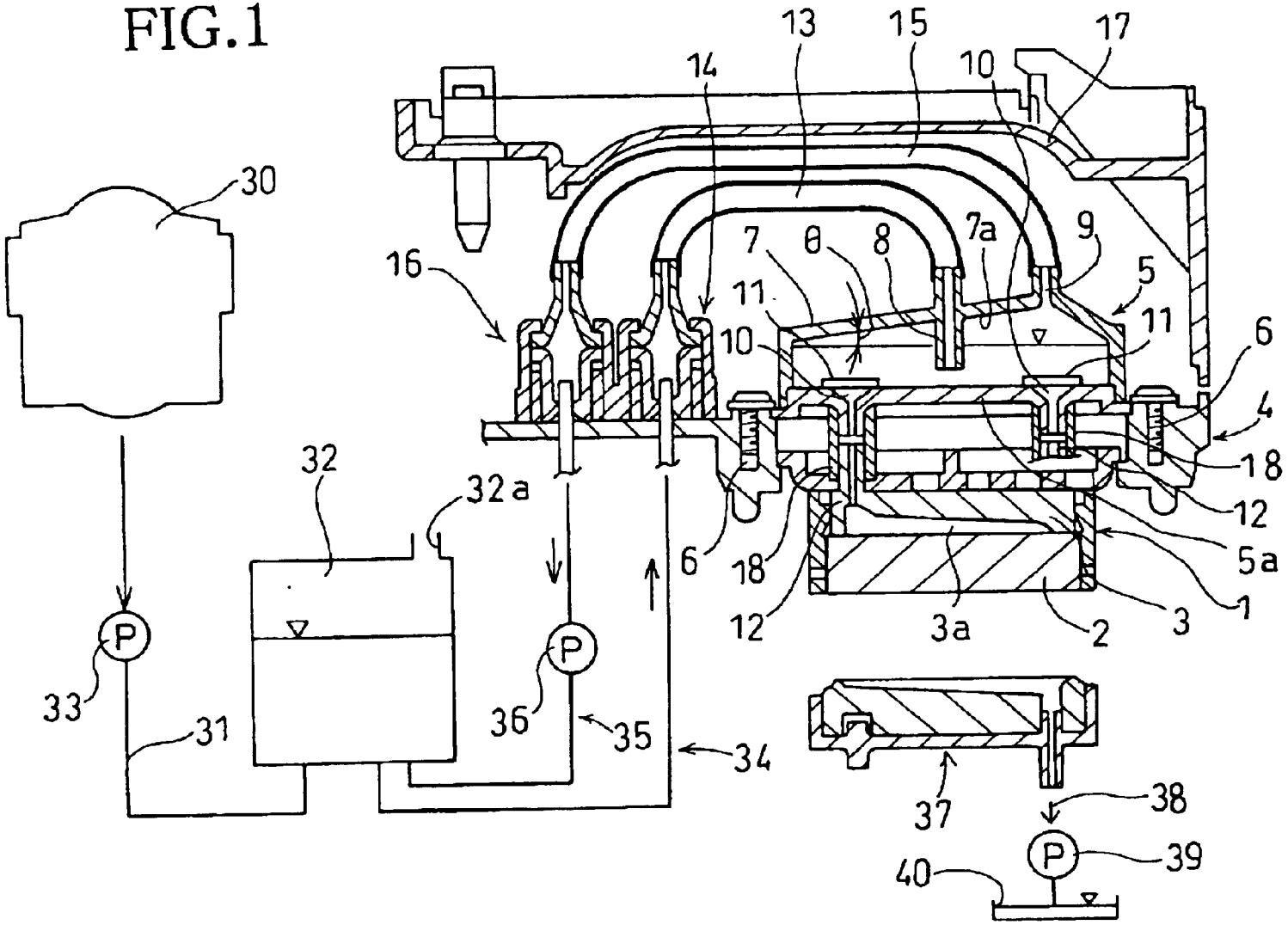
FIG. 1 is a schematic illustration of an ink jet recording apparatus according to a first embodiment of the invention.

An ink jet recording apparatus according to a first embodiment of the invention will be described. The print head unit 1 has a print head 2 member 3. The print head 2 has a plurality of ink ejection channels (not shown) on a lower side of the print head unit 1. The manifold member 3 on the upper side of the print head unit 1 has manifords 3*a* (only one of the manifolds 3*a* is shown in FIG. 1) that communicate with each of the ink ejection channels. The print head 2 and the maniford member 3 are fixedly adhered to each other.

The print head unit 1 is fixedly mounted on a lower side of a carriage 4 with, for example, an adhesive. A buffer tank 5 is detachably secured by screws 6 on an upper side of the carriage 4. An ink cartridge 30, as an ink supply source, is connected, through a flexible tube 31, to a bottom of a sub-tank 32. Ink contained in the ink cartridge 30 is supplied to the sub-tank 32 as a first pump 33 is driven. A first ink channel 34 of a flexible tube is connected to the bottom of the sub-tank 32 and an inlet 8 of the buffer tank 5, to allow the ink in the sub-tank 32 to flow into the buffer tank 5 through the first ink channel 34. A second ink channel 35 of a flexible tube is connected to the bottom of the sub-tank 32 and an outlet 9 of the buffer tank 5, to allow the ink in the buffer tank 5 to return to the sub-tank 32 through the second ink channel 35. An ink circulation pump 36 is disposed in the second ink channel 35. The sub-tank 32 is provided at its upper end with an air releasing portion 32*a* through which air bubbles in the ink returned from the buffer tank 5 are released into the atmosphere.

The ink cartridge 30 and the sub-tank 32 are disposed at stable or fixed portions outside the carriage 4.

The structures of the print head 2 are briefly described below. The structures of the print head 2 are disclosed in, for example, Japanese Laid-Open Patent Publication No. 2000-103084 and U.S. Pat. No. 5,835,110, and a detail illustration of the print head 2 is herein omitted. The print head 2 includes a plate member and two actuator plates. Each actuator plate having a row of a plurality of the ink ejection channels, is adhered to an opposite side of the plate member. The print head 2 is provided on a lower side thereof (lower side in FIG. 1), with two rows of nozzles openings that communicate with the rows of the ink ejection channels. The manifold member 3 is provided on upper sides of the actuator plates such that each manifold 3*a* of the manifold member 3 communicates with one of the rows of the ink ejection channels. An introduction conduit 12 projecting upward from the manifold 3*a* is connected to an ink outflow opening 10 formed in a bottom plate 5*a* the buffer tank 5, with a sealing tube 18 placed between the manifold 3*a* and the bottom plate 5*a*. Preferably, side walls defining the ink ejection channels in the actuator plates are formed of a piezoelectric material, and the piezoelectric material is deformed to eject ink in the ink ejection channels.

A lower end of the inlet 8 extends downward from a ceiling wall 7 of the buffer tank 5 into the buffer tank 5, and terminates near the bottom plate 5*a* of the buffer tank 5. An upper end of the inlet 8 extends upward from the ceiling wall 7. The outlet 9 for discharging ink and air bubbles therethrough is provided on one side of the ceiling wall 7. As can be seen in FIG. 1, an inner surface 7*a* of the ceiling wall 7 is provided at an angle such that the outlet 9 side becomes higher. More specifically, the inner surface 7*a* of the ceiling wall 7 is provided at an angle θ with respect to the horizontal surface. The angle θ is determined by adding approximately 5 degrees to an angle that a printer (not shown) mounting thereon an ink jet recording apparatus is allowed to be inclined when placed on a surface of, for example, a table. In this embodiment, the angle θ is within a range of approximately 5 to 15 degrees and preferably 10 degrees.

A filter 11 that catches air bubbles and foreign matter in the ink is provided inside the buffer tank 5 on an upper surface of each ink outflow opening 10 projecting downward from the bottom plate 5*a* of the buffer tank 5.

An end of a first flexible tube 13 is connected to the inlet 8 in the buffer tank 5. The other end of the first flexible tube 13 is connected to a joint member 14 mounted on a substrate on the carriage 4. The first flexible tube 13 is a part of the first ink channel 34. An end of a second flexible tube 15 is connected to the outlet 9 in the buffer tank 5. The other end of the second flexible tube 15 is connected to a joint member 16 mounted on the substrate on the carriage 4. The second flexible tube 15 is a part of the second ink channel 35. Parts of the first and second flexible tubes 13, 15 are covered by member 17 attached to the carriage 4.

The carriage 4 mounting thereon the ink jet recording apparatus structured as described above reciprocally moves across a surface of a recording medium, such as a paper sheet (not shown), in a direction perpendicular to a feeding direction of the paper sheet. A suction cap 37, used for a suction purge operation for sucking ink from the print head 2, is disposed at an end of the carriage moving area, so as to face the print head 2. During the suction purge operation, the suction cap 37 intimately contacts the lower side of the print head 2 to cover the nozzle surface of the print head 2. The ink sucked during the suction purge operation is discharged into a drain tank 40 through a suction pipe 38 and a suction pump 39.

To fill the print head 2 with ink, for example, at the time when a new ink cartridge 30 is first set on a printer, or an ink cartridge 30 is replaced with new one, the nozzle surface of the print head 2 is covered with the suction cap 37. The first pump 33 is driven to store a predetermined amount of ink in the sub-tank 32. Thereafter, the ink circulation pump 36 is driven to cause a negative pressure in the buffer tank 5. The ink in the sub-tank 32 is supplied to the buffer tank 5 from the inlet 8, through the first ink channel 34. As a certain amount of ink is stored in the buffer tank 5, air dissolved in the ink develops into air bubbles, which cling to inner surfaces of the buffer tank 5, or are suspended in ink.

The air bubbles are removed by a circulation purge operation. During the circulation purge operation, the ink is circulated from the sub-tank 32 to the buffer tank 5, through the first ink channel 34, and from the buffer tank 5 to the sub-tank 32, through the second ink channel 35. The air bubbles in the ink collected from the buffer tank 5 are separated in the sub-tank 32 and released into the atmosphere through the air releasing portion 32*a*. After the circulation purge operation is performed, the suction pump 39 is driven to perform a suction purge operation. During the suction purge operation, the ink in the buffer tank 5 is sucked from the nozzles of the print head 2 through the ink outflow opening 10, the introduction conduit 12, and the manifold 3*a*, filling the ink ejection channels of the print head 2. The suction purge operation can be performed in association with the circulation purge operation, or independently from the circulation purge operation, for example, to clear ink clogged due to drying.

Ink is stored in the buffer tank 5 such that the lower end of the inlet 8 is below the level of the ink.

Air entering through the wall of the flexible tube of the first ink channel 34 is dissolved in the ink and develops into air bubbles with the passage of time. The air bubbles eventually enter the buffer tank 5. The air bubbles in the buffer tank 5 are separated from the ink. Most of the air bubbles move upwardly toward the ceiling wall 7 of the buffer tank 5. However, due to the changes in the pressure in the buffer tank 5, which are caused, for example, when the print head 2 mounted on the carriage 4 is moved as described above, air is drawn into the ink and the resulting air bubbles are suspended in the ink, cling to the inner surfaces of the tank 5, or are caught by the filter 11. To remove the air bubbles in the buffer tank 5, the circulation purge operation is regularly performed for a set duration of time. At this time, the suction cap 37 is brought into intimate contact with the nozzle surface of the print head 2 and the suction pump 39 is not driven.

The air bubbles in the buffer tank 5 are effectively removed by the circulation purge operation, by providing the inner surface 7*a* of the ceiling wall 7 at an angle and the outlet 9 at substantially the highest portion of the inner surface 7*a*. With such a structure, even when the buffer tank 5 is filled with ink, the air bubbles are moved along the angled or inclined inner surface 7*a,* to a higher position where the outlet 9 is provided. Thus, the air bubbles in the buffer tank 5 are effectively discharged by the circulation purge operation through the outlet 9, and collected through the second ink channel 35 including the second flexible tube 15 and the joint member 16, to the sub-tank 32 where the air bubbles are discharged.

When the level of the ink supplied into the buffer tank 5 exceeds the opening (lower end) of the inlet 8, the flowing ink does not draw air in the buffer tank 5, so that generation of air bubbles are prevented. In the embodiment, the opening (lower end) of the inlet 8 is positioned near the bottom plate 5*a* of the buffer tank 5, so that the generation of the air bubbles can be minimized.

Figure 2:
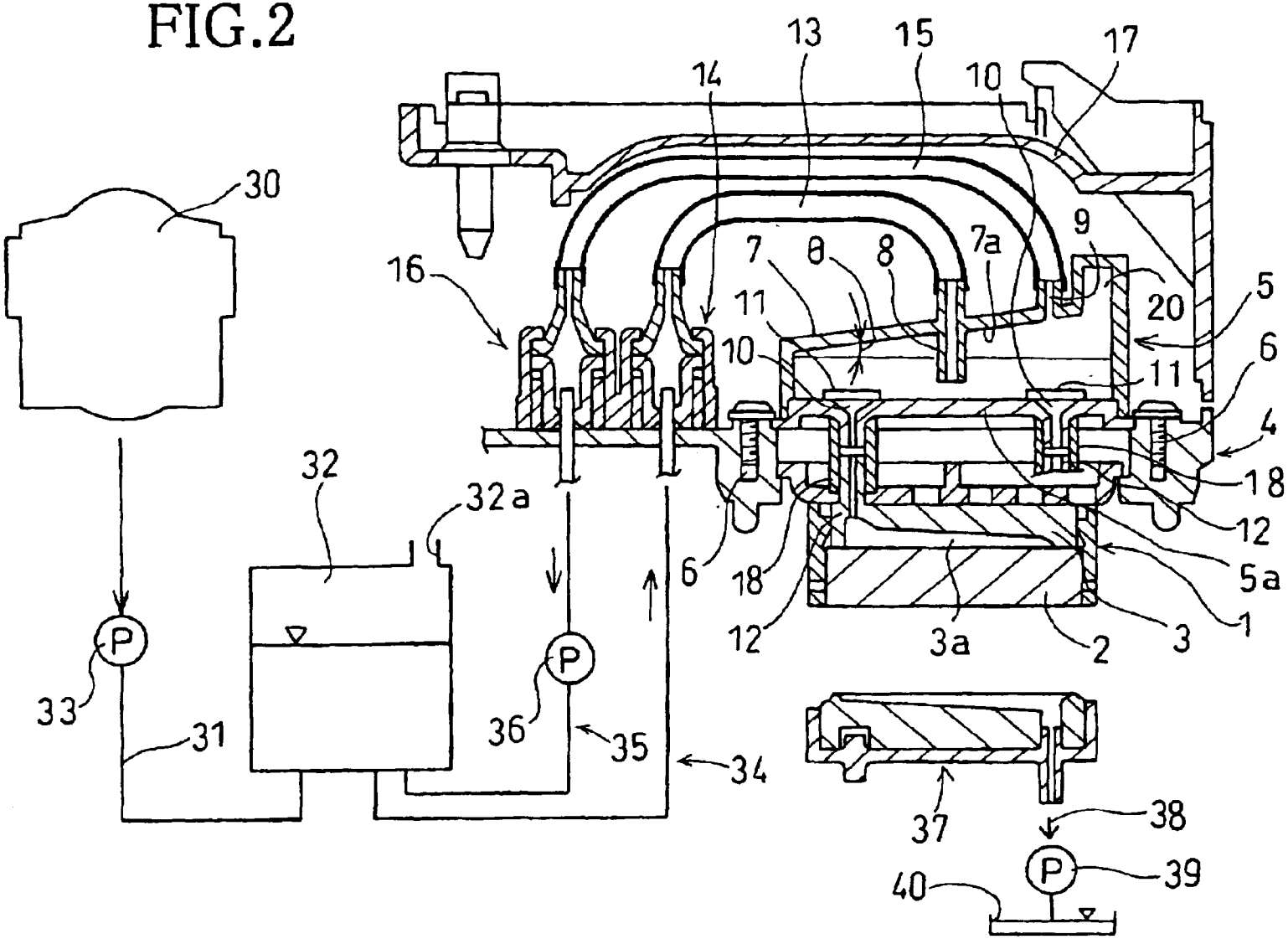
FIG. 2 is a schematic illustration of an ink jet recording apparatus according to a second embodiment of the invention.

With reference to FIG. 2, an ink jet recording apparatus according to a second embodiment will be described below. It is to be noted that like reference numerals denote like components, and a detailed explanation thereof with respect to FIG. 2 is omitted.

A buffer tank 5 of the ink jet recording apparatus according to the second embodiment includes an air space 20 formed at a position higher than the outlet 9 of the buffer tank 5. The air space 20 constantly contains the air. As the print head 2 mounted on the carriage 4 is moved during a printing (recording) operation, ink in the first ink channel 34 and the second ink channel 35 moves due to the inertia, applying pressures to the ink in the buffer tank 5. The thus caused changes in the pressures in the buffer tank 5 are absorbed by the air in the air space 20 provided at an upper portion of the buffer tank 5. Therefore, the changes in the pressures in the buffer tank 5 do not affect the ink ejection channels of the print head 2.

For the print head 2, a variety of print heads can be used. For example, thermal type print heads, that eject ink by generating heat using known heating elements to partially boil ink in the print heads, or piezoelectric type print heads, that have converters for converting electrical signals into mechanical displacements, facing ink ejection channels arranged in an array can be used. In the use of either type of the print head, the ink outflow opening 10 of the buffer tank 5 is connected to the manifold 3*a* that distributes the ink to the plurality of ink ejection channels.

The buffer tank 5 may be connected to the print head 2 directly without connecting to the manifold member 3.

The ink circulation pump 36 is disposed in the second ink channel 35 in the above-described embodiments. However, the ink circulation pump 36 may be disposed in the first ink channel 34. When the ink circulation pump 36 is disposed in the second ink channel 35 and is driven with the nozzle surface of the print head 2 covered i.e. sealed, with a suction purge device, a negative pressure is applied to the ink ejection channels of the print head 2 at the start of the ink circulation pump 36 operation. At this time, air bubbles do not enter the ink ejection channels. When the ink circulation pump 36 is disposed in the first ink channel 34 and is driven with the nozzle surface of the print head 2 covered, i.e. sealed, with the suction purge device, a positive pressure is applied to the ink ejection channels of the print head 2 at the start of the ink circulation pump 36 operation. At this time, ink does not leak from the ink ejection channels.

In the above-described embodiments, the circulation purge operation is performed with the sub-tank 32, as an ink tank, disposed between the ink cartridge 30 and the buffer tank 5. However, a circulation purge operation may be performed by circulating ink between the ink cartridge 30 and the buffer tank 5 without providing the sub-tank 32.

In the above-described embodiments, when the circulation purge operation is performed, the suction cap 37 of the suction purge device is used to cover the nozzle surface of the print head 2. However, a separate cap solely for the circulation purge operation or a maintenance cap for covering the print head 2 to prevent ink in the nozzles from drying out may be used.

When the circulation purge operation is performed by circulating ink through the first ink channel 34 and the second ink channel 35, provided between the sub-tank 32 and the buffer tank 5, using the ink circulation pump 36 disposed in the second ink channel 35, air bubbles in the ink stored in the buffer tank 5 can be effectively discharged without being left in the tank 5, because the outlet 9 to the second ink channel 35 is disposed at a position higher than the inlet 8 through which ink in the first ink channel 34 enters into the buffer tank 5.

Substantially the entire inner surface 7*a* of the ceiling wall 7 is formed at a predetermined angle with respect to the horizontal surface, so that the outlet 9 to the second ink channel 35 can be disposed at a higher position of the inner surface 7*a* of the ceiling wall 7. Therefore, the air bubbles in the buffer tank 5 can be removed effectively during a short period of time by the circulation purge operation.

The angle of the inner surface 7*a* of the ceiling wall 7 with respect to the horizontal surface is set to 5 degrees or greater. Such a setting allows the ceiling wall 7 of the buffer tank 5 on the side of the outlet 9 to be positioned higher, even when a printer mounting thereon the ink jet recording apparatus is placed on a surface angled to such a degree that allows normal functions of the ink jet recording apparatus to be preserved. Therefore, the air bubbles in the buffer tank 5 can be effectively removed.

The inlet 8 to the buffer tank 5 from the first ink channel 34 is provided at a position lower than the outlet 9 to the second ink channel 35. As ink supplied to the buffer tank 5 exceeds the lower end of the inlet 8, the ink subsequently entering the buffer tank 5 through the inlet 8 flows in the ink without drawing air in the buffer tank 5 into the ink. Therefore, when the circulation purge operation is performed, air bubbles in the buffer tank 5 can be smoothly removed while the generation of air bubbles is prevented.

As the nozzle surface is covered with the suction purge device when the circulation purge operation is performed, entry of air bubbles into the ink ejection channels of the print head 2, ink leakage, and nozzle clogging can be prevented. Even if nozzle clogging occurs, the clogging can be smoothly cleared by operating the suction purge device.

The print head 2 and the buffer tank 5 are mounted on the movable carriage 3. The sub-tank 32, as the ink tank, is disposed outside the carriage 4. The first ink channel 34 and the second ink channel 35 are flexible tubes that connect the buffer tank 5 and the sub-tank 32. Air entering through the flexible tubes 13, 34 and developing into air bubbles can be discharged smoothly from the buffer tank 5, so that stable ink ejection can be achieved.

Although the invention has been described with reference to the embodiments, it is to be understood that the invention is not restricted to the particular forms shown in the foregoing embodiments. Various modifications and alterations can be made thereto without departing from the scope of the invention, as set forth in the appended claims.

What is claimed is:

1. An ink jet recording apparatus, comprising:

a print head that has a plurality of ink ejection channels;

an ink tank that stores ink;

a buffer tank that has an inlet and an outlet, both the inlet and outlet in a ceiling of the buffer tank, the buffer tank storing the ink supplied from the ink tank;

a first ink channel that supplies the ink from the ink tank to the buffer tank through the inlet;

a second ink channel that collects the ink from the buffer tank to the ink tank through the outlet; and a pump that is activated to circulate the ink between the ink tank, the first ink channel, the buffer tank, and the second ink channel, wherein the outlet is disposed higher than the inlet at the ceiling of the buffer tank.

2. The ink jet recording apparatus according to claim 1, wherein substantially an entire inner surface of the ceiling is provided at a predetermined angle with respect to a horizontal surface.

3. The ink jet recording apparatus according to claim 2, wherein the predetermined angle is 5° or greater.

4. The ink jet recording apparatus according to claim 1, further comprising a suction purge device that sucks the ink in the ink ejection channels of the print head, from a side that the ink is ejected.

5. The ink jet recording apparatus according to claim 1, wherein the print head and the buffer tank are mounted on a movable carriage, the ink tank is disposed outside the carriage, and the first ink channel and the second ink channel are flexible tubes connecting the buffer tank and the ink tank.

6. The ink jet recording apparatus according to claim 1, wherein the buffer tank further includes an air space that stores air therein and the air space is disposed higher than the outlet.

7. The ink jet recording apparatus, according to claim 1, wherein the ink tank has an air releasing portion in a ceiling thereof.

8. An ink jet print system, comprising:

a carriage;

a print head mounted to the carriage;

a buffer tank mounted to the carriage that supplies ink to the print head, the buffer tank having an ink inlet and an outlet in an upper surface;

an ink supply channel;

a removal channel;

a tank, the ink supply channel and the removal channel extending from the tank to the buffer tank; and a pump in one of the ink supply channel and the removal channel, wherein an opening of the ink inlet is lower than the outlet and the upper surface of the buffer tank is inclined upwardly to the outlet.

9. The ink jet print system according to claim 8, wherein the pump is in the removal channel.

10. The ink jet print system according to claim 8, further comprising:

a second tank;

a second ink supply channel extending from the second tank to the tank; and a second pump in the second ink supply channel.

11. The ink jet print system according to claim 8, wherein the ink supply channel and the removal channel each comprise:

a first flexible tube;

a joint member mounted on the carriage; and a second flexible tube, the first flexible tube extending between the joint member and the buffer tank and the second flexible tube extending between the tank and the joint member.

12. The ink jet print system according to claim 8, wherein the upward inclination of the upper surface is between 5 and 15° relative to a horizontal plane defined by a levelly mounted printer, the upward inclination measured at a point furthest from the outlet.

13. The ink jet print system according to claim 12, wherein the upward inclination is substantially 10°.

14. The ink jet print system according to claim 8, further comprising an air chamber formed in the upper surface of the buffer tank.

15. The ink jet print system according to claim 14, wherein the air chamber is proximate the outlet.

16. The ink jet print system according to claim 8, wherein an air vent is formed in the tank.

17. The ink jet print system according to claim 8, further comprising a head cover.

18. An air purge system for an ink jet print mechanism mounted on a carriage, comprising:

a buffer tank mounted to the carriage that supplies ink to a print head, the buffer tank having an ink inlet and an outlet in an upper surface;

an ink supply channel;

a removal channel;

a tank, the ink supply channel and the removal channel extending from the tank to the buffer tank; and a pump in one of the ink supply channel and the removal channel, wherein an opening of the ink inlet is lower than the outlet and the upper surface of the buffer tank is inclined upwardly to the outlet, wherein the ink supply channel and the removal channel each comprise:

a first flexible tube;

a joint member mounted on the carriage; and a second flexible tube, the first flexible tube extending between the joint member and the buffer tank and the second flexible tube extending between the tank and the joint member.

19. The air purge system according to claim 18, wherein the upward inclination of the upper surface is between 5 and 15° relative to a horizontal plane defined by a levelly mounted printer, the upward inclination measured at a point furthest from the outlet.

20. The air purge system according to claim 18, further comprising an air chamber formed in the upper surface of the buffer tank.

21. The air purge system according to claim 18, further comprising a print head cover.

* * * * *